US005823120A

United States Patent [19]

Holmquist

[11] Patent Number: 5,823,120

[45] Date of Patent: Oct. 20, 1998

[54] VERTICALLY ADJUSTABLE DESKTOP, PREFERABLY A SCHOOL DESK

[75] Inventor: Roland Holmquist, Vingåker, Sweden

[73] Assignee: JELTEC Ergonomiteknik AB, Katrineholm, Sweden

[21] Appl. No.: 50,318

[22] PCT Filed: Nov. 13, 1991

[86] PCT No.: PCT/SE91/00770

§ 371 Date: May 10, 1993

§ 102(e) Date: May 10, 1993

[87] PCT Pub. No.: WO92/08392

PCT Pub. Date: May 29, 1992

[30] Foreign Application Priority Data

Nov. 13, 1990 [SE] Sweden ..... 90036070

[51] Int. Cl.[6] ..... A47B 9/00

[52] U.S. Cl. ..... 108/147; 108/145

[58] Field of Search ..... 108/147, 7, 9, 108/144, 145, 144.11

[56] References Cited

U.S. PATENT DOCUMENTS

| | | | |
|---|---|---|---|
| 2,982,050 | 5/1961 | May | 108/145 X |
| 3,080,835 | 3/1963 | Guglielmi | 108/147 X |
| 3,698,327 | 10/1972 | Litvinoff et al. | 108/2 |
| 3,703,147 | 11/1972 | Selander | 108/145 |
| 4,383,486 | 5/1983 | Reineman et al. | 108/10 X |
| 4,577,821 | 3/1986 | Edmo et al. | 108/147 X |
| 4,898,103 | 2/1990 | Pontoppidan et al. . | |
| 5,005,492 | 4/1991 | Ogino et al. | 108/145 |

FOREIGN PATENT DOCUMENTS

| | | | |
|---|---|---|---|
| 2539713 | 3/1977 | Germany | 108/10 |
| 416771 | 2/1981 | Sweden . | |
| 429093 | 8/1983 | Sweden . | |
| 444258 | 4/1986 | Sweden . | |

*Primary Examiner*—Jose V. Chen

*Attorney, Agent, or Firm*—Watson Cole Grindle Watson, P.L.L.C.

[57] ABSTRACT

A vertically adjustable desk includes a support stand, a desktop with underbody and linkages of parallel links that connect the underbody to the support stand such that the desktop can be vertically adjusted above the support stand. A gas spring with handle connects each linkage with the underbody to assist in vertical movement of the desktop and, by use of the associated handle, to releasably lock the desktop in desired vertical positions.

3 Claims, 2 Drawing Sheets

VERTICALLY ADJUSTABLE DESKTOP, PREFERABLY A SCHOOL DESK

BACKGROUND OF THE INVENTION

1. Field of the Invention

The present invention relates to a vertically adjustable desktop, preferably a school desk, which can be adjusted into a required vertical position by a simple manipulation and by a small adjusting force, but which for the most part cannot be unintentionally or impermissibly adjusted.

2. The Prior Art

As early as 1887 an adjustable desk was patented —see SE-A-937. The desktop and bench thereof are vertically adjustable irrespective of; the size and age of the user. This is also the case in SE-A-90.219 disclosing a desk which is vertically adjustable by a complex gabel mechanism. Also SE-A-110.686 discloses a combination of a seat and a desk wherein a complicated handling is involved in adjusting the bench and the desktop. SE-A-20.872, SE-A-117.294 and SE-A-184.113 all disclose more or less complex mechanisms and devices to adjust the combination desk/seat.

SE-B-8107530-1 discloses a balancing device on a table, preferably a drawing table, where the object is to eliminate the difficulties in adjusting the table to equilibrate the load on the table, which load can be about 15–60 kp.

The working position forced onto youngsters during school work in an ordinary desk is often of a kind that,—by the unconscious ability of the body to try to compensate for distorted afflictions, forms the basis defective working positions in later life. Thus, it is of an extreme importance that young people as long as possible are able to change their working positions, i.e., during the year at school, and preferably to make a simple variation of the working position or the physical position possible without necessarily stopping actual work, and if so is the case just for a few seconds.

The object according to the present invention is to obtain a desk, preferably a desk for use at school, wherein a vertical adjustment can be performed infinitely with a simple manipulation and with a small adjusing force, whereby the risk for unintended or not permitted adjustment, e.g., when a person is sitting upon the desk, is eliminated.

SUMMARY OF THE INVENITON

This object is achieved by a desk having the characterizing clauses stated in the claims.

By making the underbody including a parallel linkage to which the one end of a gas spring means is articulately connected to form a lever to the articulated connection point in the underbody of the desk, the gas spring means will carry the weight of the desk (accumulating the potential energy of the desktop) during all vertical adjustment positions of the desk, wherein the rod piston of the gas spring means will remain locked unless a valve means in the gas spring means is actuated in connection to the adjustment, which takes place by adjusting handles in close connection to the desktop. Preferably two adjusting handles are arranged in connection to each of the gas spring means at the underbody of the desk and at the parallel linkage, i.e., two hands have to be used to adjust the vertical position of the desk. This is according to the present invention obtained without that the mechanism at the desk allowing this to happen in itself is voluminous or is intruding on the space for the legs under the desk.

BRIEF DESCRIPTION OF THE DRAWINGS

The invention will now be described in connection to one embodiment shown in the appended drawings, wherein.

DETAILED DESCRIPTION OF THE PREFERRED EMBODIMENT

Figure 1:
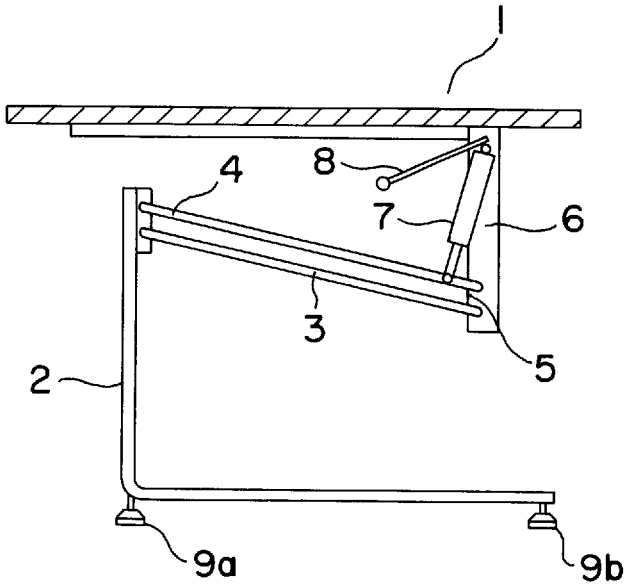
FIG. 1 is a schematic side view—of a desk according to the inveniton in a lowered working position.

In FIG. 1 the desk is shown with a desktop 1, a lower stationary stand 2, a linkage 3 (of which just one half is shown in the figures), attachment points 4 and 5 at the stand 2 and at the underbody 6 of the desk, respectively. Preferably the desk has a square desktop 1. Preferably the stationary stand 2 has a cross bar (not shown) a distance up on its vertical portion. There is also a cross bar between the two parts of the parallel linkage 3, preferably between the two upper links in the linkage. Preferably the underbody 6 also includes a cross bar (not shown). At the underbody 6—at each half (just one shown in the figure)—a cylinder of the gas spring means is articulated connected. Each gas spring means is seen to include a piston rod pivotally connected to the upper link of the associated part of the linkage 3. The movable pistons in this gas spring means are lockable or blockable through a valve and actuable by a handle 8 actuating the valve when a vertical adjustment of the desk top 1 shall take place. At this stage the gas spring means 7 allows a change in the vertical position of the desktop 1, whereby in the lower position shown in FIG. 1 the gas spring is "charged" with the energy corresponding to the potential energy between the highest adjusting position (FIG. 3) and the lowest adjusting position ( FIG. 1) Thus , when actuating the handle 1 the energy is released from the gas spring means 7 performing a lifting force via the piston rod and the lever being formed at the upper link in the linkage 3 during a vertical adjustment upwards, and which essentially corresponds to the weights of the desktop 1 and of the underbody 6.

Figure 2:
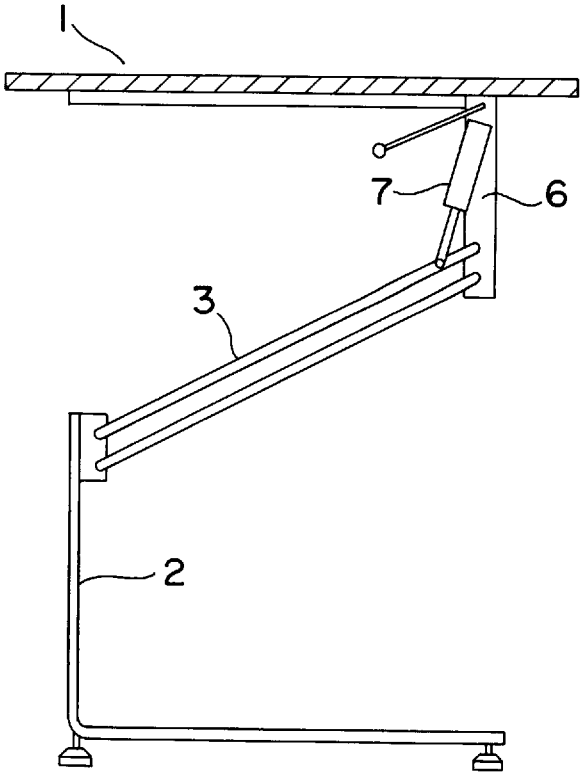
FIG. 2 illustrates the desk according to FIG. 1 in a middle position.

In FIG. 2 a middle adjusting position is shown wherein the piston rod of the gas spring means 7 can be seen in a more protruding position.

Figure 3:
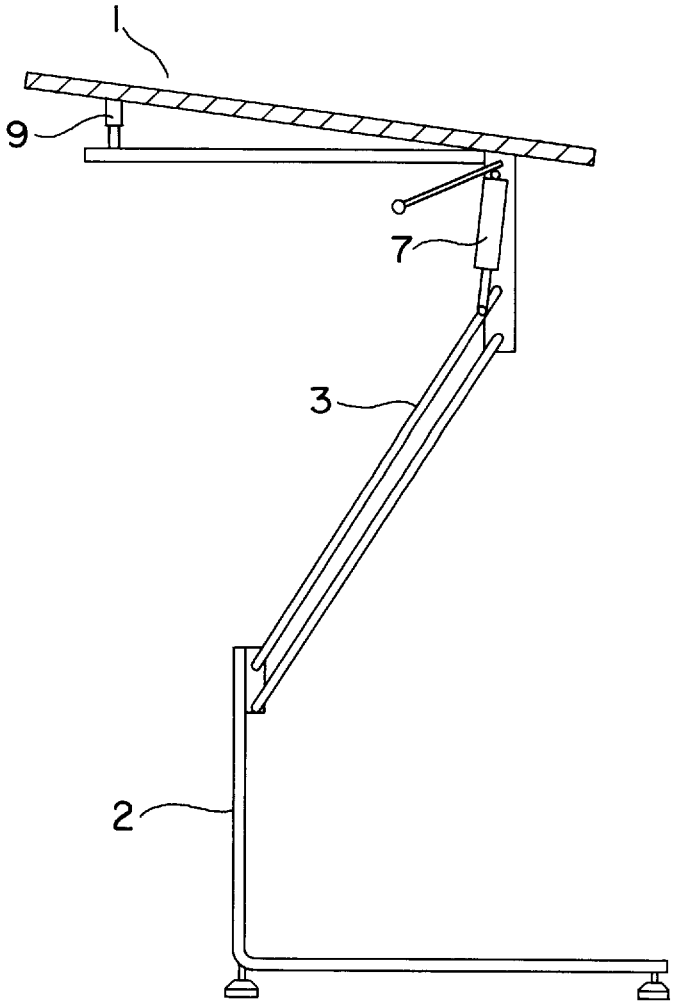
FIG. 3 illustrates a desk according to FIG. 1 in the highest position, wherein the desktop is shown in a first folded position.

In FIG. 3 the highest adjusting position is shown where the piston rod of the gas spring means can be seen in its outmost protruding position. This figure illustrates that the gas spring means 7 in itself has been articulated around its point of connection in the desktop 1 supporting the underbody 6. In FIG. 3 also the possibility to adjust the desktop 1 in a horizontal plane by a simple retaining mechanism 9 is shown.

To be able to handle the proportionately great forces acting upon and through the gas spring, the latter is preferably connected in a closed U-grider.

Yet another advantage with the present invention is obtained if the desktop is so arranged that it cannot be adjusted in a vertical direction when a certain excessive pressure exists in the gas spring means. This is done to eliminate the risk that the desktop is unintentionally adjusted downwards when a person is sitting on the desktop, or when the desk by some other reason is overloaded. The risk for this to happen is imminent when the desks are used at school.

The invention is not restricted to the illustrated embodiment. Modifications can be made within the scope of the appended claims.

I claim:

1. A vertically adjustable desk which comprises:

a support stand, a desktop which includes an underbody, first and second linkage means connected between said support stand and said underbody for vertically adjustably positions said desktop in a generally horizontal orientation above said lower stand, each of said first and second linkage means comprising two parallel links, and first and second gas spring means connected between said first linkage means and said underbody and between said second linkage means and said underbody, respectively, said first and second gas spring means operating to assist in vertical movement of said desktop above said support stand and to lock said desktop in vertical position above said support stand, each of said first and second gas spring means including a handle for manual operation thereof.

2. A vertically adjustable desk according to claim 1, wherein each of said first and second gas spring means includes a valve for locking and unlocking movement thereof and wherein said handles attached to said first and second gas spring means are capable of opening and closing said valves therein.

3. A vertically adjustable desk which comprises:

a support stand, a desktop which includes an underbody, first and second linkage means connected between said support stand and said underbody for vertically adjustably positioning said desktop in a generally horizontal orientation above said lower stand, each of said first and second linkage means comprising two parallel links, first gas spring means comprising a first cylinder containing gas which is pivotally connected to said underbody, a first piston movable within said first cylinder and including a piston rod pivotally connected to said first linkage means, first valve means for controlling the flow of gas in said first cylinder such that said gas can assist in lifting said desktop or lock said desktop in a vertical position, and a first handle means attached to said first valve means for operating said first valve means, and second gas spring means comprising a second cylinder containing gas which is pivotally connected to said underbody, a second piston movable within said second cylinder and including a piston rod pivotally connected to said second linkage means, second valve means for controlling the flow of gas in said second cylinder such that said gas can assist in lifting said desktop or lock said desktop in a vertical position, and a second handle means attached to said second valve means for operating said second valve means.

* * * * *